United States Patent [19]

Insley

[11] 3,995,184

[45] Nov. 30, 1976

[54] ALUMINA-SPINEL DIFFUSION SEMICONDUCTOR

[75] Inventor: Robert H. Insley, Royal Oak, Mich.

[73] Assignee: Champion Spark Plug Company, Toledo, Ohio

[22] Filed: Dec. 3, 1975

[21] Appl. No.: 637,286

Related U.S. Application Data

[63] Continuation of Ser. No. 445,164, Feb. 25, 1974, abandoned.

[52] U.S. Cl. ..... 313/131 A; 29/25.12; 313/136

[51] Int. Cl.[2] ..... H01T 13/02

[58] Field of Search ..... 313/131, 131 A, 136; 264/66; 29/25.12

[56] References Cited

UNITED STATES PATENTS

| | | | |
|---|---|---|---|
| 2,265,352 | 12/1941 | Corbin et al. | 313/136 |
| 2,684,665 | 7/1954 | Tognola | 313/131 |
| 2,926,275 | 2/1960 | Peras | 313/131 |
| 2,953,704 | 9/1960 | Harris | 313/131 |
| 3,037,140 | 5/1962 | Schurecht | 313/131 |

*Primary Examiner*—John Kominski
*Attorney, Agent, or Firm*—John C. Purdue

[57] ABSTRACT

An improved semiconductor and semiconductor coating for alumina electrical insulating devices is disclosed. The semiconductor is prepared by applying a layer of a mixture of monoxide and sesquioxide combination to an alumina body and firing at a temperature of 2300° or above thereby forming a stable spinel. The electrically-conductive monoxide can be FeO, $Cu_2O$, CuO, NiO, CoO or MnO. The sesquioxide can be $Fe_2O_3$, $Cr_2O_3$, $Ga_2O_3$, $Ca_2O_3$, $Mn_2O_3$, $Al_2O_3$ or $Ti_2O_3$.

5 Claims, 4 Drawing Figures

ALUMINA-SPINEL DIFFUSION SEMICONDUCTOR

This is a continuation of application Ser. No. 445,164 filed Feb. 25, 1974 and now abandoned.

BACKGROUND OF THE INVENTION

This invention relates to semiconductors and coatings of semiconductive materials on electrical insulator structures made of alumina. More particularly, the invention relates to electrical discharge producing devices having a pair of electrodes which are connected by an electrical insulator structure coated with a semiconductive material having an electrical resistance that increases as a function of the distance inwardly from the exposed surface of the semiconductive material.

While the present invention will have utility in all types of applications where semiconductors are used, it has particular advantages in the field of spark plugs and jet engine igniters. Thus, it is in this connection that the invention will be described.

A spark plug or jet engine igniter of the type with which the invention is concerned generally comprises a tubular shell, and a centrally located electrode separated therefrom by an annular insulator. A portion of the center electrode at one end of the insulator is in spark gap relation with a portion of the shell or an associate ground electrode.

In a low voltage igniter an electrically semiconductive material is provided, electrically connecting the center and ground electrodes.

In one proposed construction, the tubular shell has been provided with a radially inwardly extending shoulder, and the center electrode has been provided with a radially outwardly extending shoulder, and an angular disc of semiconductive material having appreciable thickness has been positioned between the shell and center electrode in such manner that the two electrodes contact the semiconductive material only on its exposed surface. It is suggested that by limiting the contact to the exposed surface of the semiconductive material a spark of maximum intensity can be achieved adjacent the exposed surface. However, a considerable amount of electricity flows through the interior of the conductive material where its flow does not contribute to the spark intensity. A further difficulty exists in the above-described design in that the sides of the disc of semiconductive material must be insulated from the center electrode and shell, so that a partial short circuit between the electrodes is not provided by the portions of the semiconductive material inwardly from its exposed surface.

In another type of structure which has been proposed heretofore, a thin engobe coating of a semiconductive material having a relatively high conductivity is provided on the surface of a fixed insulator positioned between the electrodes. One difficulty inherent in the use of thin coatings of semiconductors having relatively high conductivity is that the service life of these thin coatings is relatively short due to arosion caused by the spark discharge and highly turbulent gases.

SUMMARY OF THE INVENTION

The instant invention is based upon the discovery that a conductive oxide such as FeO, $CU_2O$, CuO, NiO, CoO and MnO can be partially stabilized by combination of the oxide with another oxide such as $Fe_2O_3$, $Cr_2O_3$, $Ga_2O_3$, $Ca_2O_3$, $Mn_2O_3$, $Al_2O_3$, and $Ti_2O_3$. A layer of the spinel mixture is applied to an alumina body and fired to 2300° or above. Firing causes the $Al_2O_3$ from the alumina body to be absorbed into the spinel as the spinel is being formed. Adsorption of the alumina into the spinel produces a decrease in resistance as a function of the distance outwardly from the semiconductor-alumina interface.

It is an object of this invention to provide a new and improved igniter, spark plug or similar device which is more efficient and has greater service life than those produced heretofore.

Another object of the invention is the provision of a new and improved alumina insulator having a semiconductive coating thereon of appreciable thickness, and having such resistance characteristics to cause a flow of electricity therethrough to be concentrated at the surface of the coating.

Another object of the invention is the provision of a new and improved alumina insulator having a layer of a semiconductive material thereon through which alumina is diffused at amounts varying from a high concentration adjacent the alumina body to a low concentration at the surface of the semiconductive material.

Further objects and advantages will become apparent to those skilled in the art with the following description of several embodiments described with reference to the accompanying drawings forming a part of this specification.

DESCRIPTION OF THE PREFERRED EMBODIMENT

Figure 1:
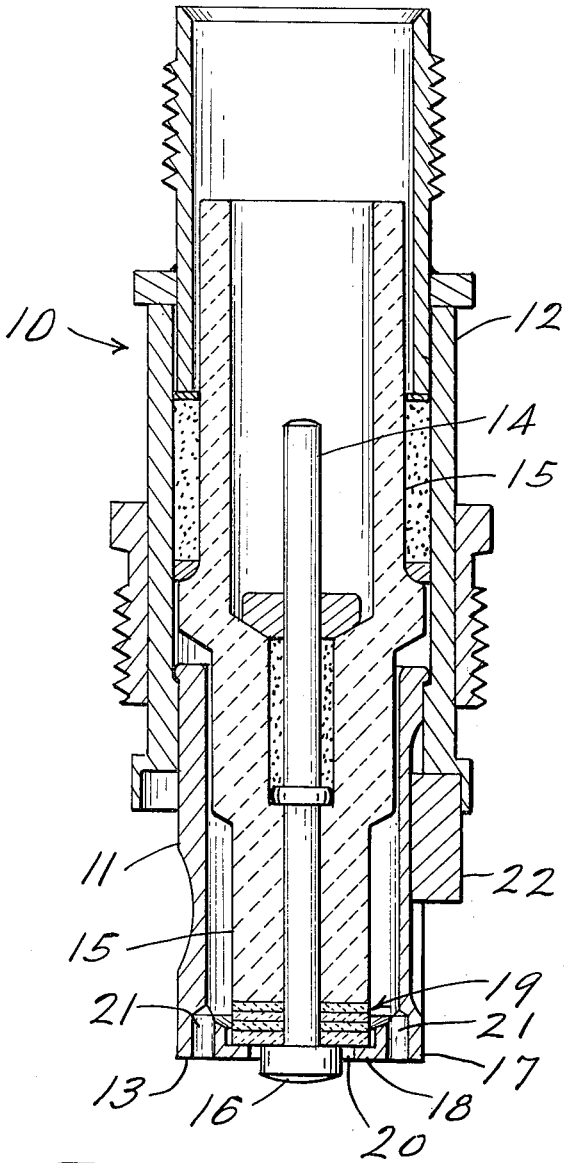
FIG. 1 is a fragmentary view showing a lower end of a jet engine igniter constructed according to the invention.

Although the invention may be otherwise embodied, it is herein described with particular reference to a jet engine igniter. The igniter shown in FIG. 1 comprises a metallic tubular shell 10 which has a reduced lower section 11 integrally connected to a relatively larger superior section 12. The reduced lower section 11 has a radially outwardly extending flange 13 adjacent its lower end. A center electrode 14 is positioned inside the tubular shell 10 and is insulated therefrom by means of an annular insulating sleeve 15 that is composed essentially of $Al_2O_3$ (approximately 92%).

At the lower end of the center electrode 14 is provided an enlarged radially outwardly extending portion 16 having a conical surface. Spaced apart from the enlarged portion 16 and concentric to it is an outer electrode 17 with an inwardly extending flange portion 18, which is permanently connected to the reduced lower shell section 11. Bonded to the end of the insulating sleeve 15 is an alumina body 19 with the semiconductive coating of the invention described herein thereon, and shown in more detail in FIG. 2. The body 19 abuts both the enlarged radially outwardly extending portion of the center electrode 16, and the inwardly extending flange portion 18 of the outer electrode 17.

The body 19 with semiconductive coating thereon forms a semiconductive shunt across the annular gap 20 between the two electrodes 14 and 17. Body 19 is bonded to the lower end of the insulator 15 in a manner to be described.

The reduced lower shell section 11 is provided with a circular hole 21 at the lower end thereof to allow gas entry to the annular space between the insulating sleeves 15 and the reduced shell portion 11, thereby to prevent undue progressive build up of temperature in the insulator 15.

A key or lug 22 projecting from the lower shell 11 is adapted to be received in a device locating recess in the engine housing.

Figure 2:
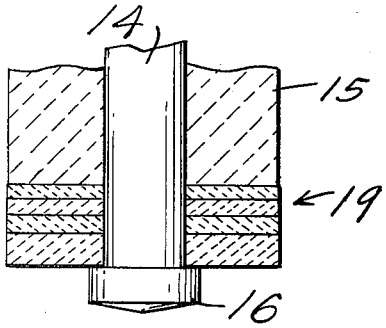
FIG. 2 is a cross-sectional view of a portion of the lower end of the igniter of FIG. 1 showing parts in greater detail.

As shown in FIG. 2 the alumina body containing the semiconductive coating is bonded to the insulating sleeve 15 surrounding the central electrode 14. This body 19 consists of alumina with a semiconductive layer on the lower surface thereof, as will be explained further herein.

The semiconductive coating is bonded to an alumina body 19 that is preferably an integral part of the insulating sleeve 15. The semiconductive coating is considerably thicker than the usual engobe coating, yet is not a separate body that is merely bonded to the alumina body.

The principal oxides which will conduct electricity are FeO, $Cu_2O$, CuO, NiO, CoO, and MnO. All of these oxides are unstable at temperatures approaching about 2000° F. in that they may undergo a change in oxidation state, depending upon the atmosphere to which they are subjected, forming oxides which are considerably less conductive. According to the invention it has been found that the above-mentioned conductive oxides can be at least partially stabilized by combining them with other oxides forming a spinel which will prevent or retard the change in oxidation state. For example, the monoxides FeO, $Cu_2O$, CuO, NiO, CoO, and MnO can be combined with one or more of the following sesquioxides: $Fe_2O_3$, $Cr_2O_3$, $Ga_2O_3$, $Ca_2O_3$, $Mn_2O_3$, $Al_2O_3$, and $Ti_2O_3$ to form a spinel. The metal of the monoxide of the spinal should preferably be different from the metal of a sesquioxide.

According to the invention, a layer of a mixture of one or more of the above described spinel-forming monoxide and sesquioxide combinations is applied to the alumina body and is fired to approximately 2300° F. or above so that $Al_2O_3$ from the alumina body is absorbed into the spinel as it is being formed. It is believed that the $Al_2O_3$ displaces some of the sesquioxide of the spinel in the semiconductive layer and that the rate at which the $Al_2O_3$ migrates into the semiconductive layer is increased by this mechanism. In any event, $Al_2O_3$ will diffuse through a spinel layer 0.020 to 0.030 inches in thickness in approximately 2 hours at 2650° F. The above-listed monoxides and sesquioxides, other than $Al_2O_3$, form spinels in less than about 5 minutes at temperatures above about 2300° F. The oxide mixture which forms the semiconductive layer should preferably be pressed either simultaneously with a ceramic batch comprising alumina or against a pressed body of ceramic batch of alumina and preferably both are then fired simultaneously to enhance the diffusion process.

Figure 3:
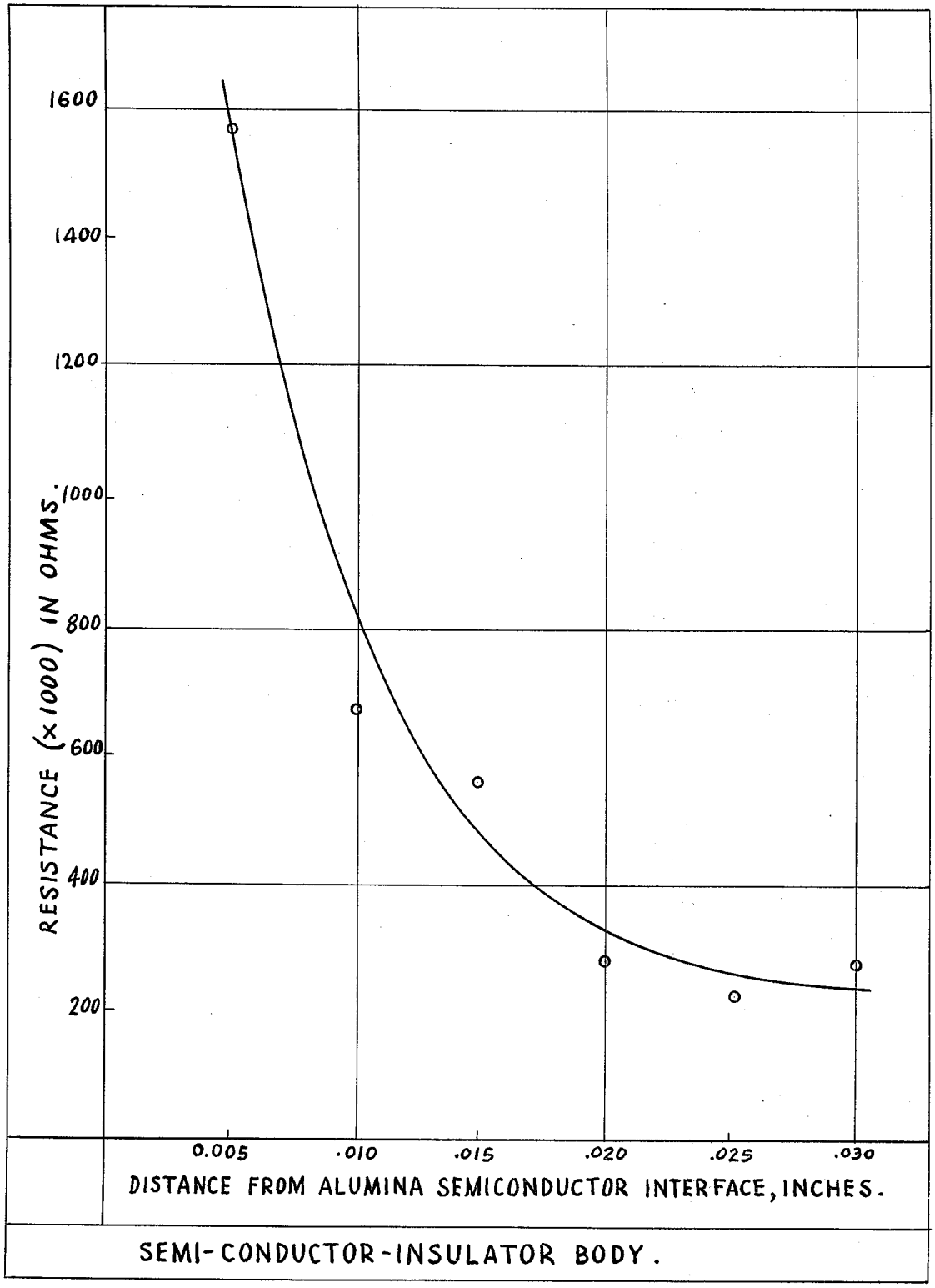
FIG. 3 is a graph of the electrical resistance versus distance from the interface between a conductive layer and an insulator body used in the spark gap of an igniter shown in FIG. 1; and, FIG. 4 is a graph showing the change in resistance of two different engobe coatings during use at elevated operating temperatures.

The fact that the above spinels absorb alumina in the manner above described produces several very desirable effects. It increases the bond strength between the semiconductive materials and alumina insulator body, and it modifies the coefficient of expansion of the semiconductive material so that it more closely approaches that of the alumina insulator body. In addition, the concentration of the alumina in the semiconductive material is greatest adjacent the insulator body decreasing as an exponential function of the distance from the insulator-semiconductor interface. This gives rise to the very desirable relationship of electrical resistance versus distance from the insulator body that is shown in FIG. 3 of the drawings where it is seen that the resistance decreases as a function of the distance outwardly from the semiconductor-alumina interface. The data from which the curves in FIG. 3 was made was attained by pressing a semiconductive batch composition consisting of 75 percent of a powdered calcined solid solution of 40 percent $CuFe_2O_4$ and 60 percent $CuCr_2O_4$, and 25 percent of a powdered alumina in contact with ceramic batch consisting essentially of $Al_2O_3$ at 50,000 psi to form a body ¼ inch in diameter by ½ inch long. The compressed layer of semiconductor batch was approximately 0.030 inch thick. The body was then fired for 2 hours at 2650° F. and the resistance at 12 volts was measured using probes spaced ⅛ inch apart. After this measurement a 0.005 inch thick portion of the coating adjacent the semiconductor surface was removed by lapping with a 240 grit diamond wheel and the resistance of the newly exposed surface was measured. Additional 0.005 inch increments of the material were removed and the resistance of each newly exposed surface was measured as above-described to provide the data given in FIG. 3. By way of comparison, a value of 230,000 ohm resistance measured when 12 volts are supplied to the probe placed in contact with the surface of the semiconductive material corresponds to 10,000 ohms read when 500 volts are supplied to the same probes and surface.

The following tests were made to further demonstrate that alumina from an insulator body diffuses into a spinel material and increases the resistance of the electrically semiconductive spinel. A 200 gram charge of a mixture consisting of 33.7 weight percent of CuO, 33.4 weight percent of $Fe_2O_3$, and 32.9 weight percent of $Cr_2O_3$ was mixed with 300 cc of water and ground in a ball mill for 9 hours. This slip mixture is designated hereafter CF-1. A second charge of 200 grams of a mixture consisting of 28.6 weight percent CuO, 28.4 weight percent $Fe_2O_3$, 28.0 weight percent $Cr_2O_3$, 10.0 weight percent feldspar and 5.0 weight percent of flint was mixed with 300 cc of water and ground in a ball mill for nine hours. This second slip mixture is hereafter designed CF-2. Alumina insulator bodies were prepared by pressing a ceramic batch comprising alumina at 50,000 psi and calcining to vitrification. Tests were made by dipping an insulator into one of the slips (dispersion of spinel compound) to apply a thin coating, firing the coated insulator in air for 5 minutes at a particular temperature, and measuring the resistance of the surface of the coating, using probes placed ⅛ inch apart and a DC potential ot 500 volts. Thereafter, the insulator was again dipped into the same slip to apply a second coating, and fired in air for 5 minutes at the same temperature, and the resistance of the new surface was measured in the same manner as before. This process was repeated five times for each slip and firing temperature to provide the data given in Table I.

TABLE I

| Firing Temperature | | Firing Time | (CF-1) Total Coating Thickness | (CF-1) Resistance in Ohms | (CF-2) Firing Time | (CF-2) Total Coating Thickness | (CF-2) Resistance in Ohms |
|---|---|---|---|---|---|---|---|
| 2650° F., | 1 coat | 5 min. | .0005" | 400,000 | 5 min. | .0005" | 200,000 |
| " | 2nd coat | " | .0010" | 350,000 | " | .0015" | 150,000 |
| " | 3rd coat | " | .0015" | 90,000 | " | .0020" | 50,000 |
| " | 4th coat | " | .0025" | 40,000 | " | .0025" | 25,000 |
| " | 5th coat | " | .0025" | 50,000 | " | .0035" | 20,000 |
| 2600° F., | 1 coat | 5 min. | .0005" | 450,000 | 5 min. | .0005" | 350,000 |
| " | 2nd coat | " | .0010" | 400,000 | " | .0010" | 60,000 |
| " | 3rd coat | " | .0020" | 90,000 | " | .0025" | 40,000 |
| " | 4th coat | " | .0020" | 20,000 | " | .0035" | 25,000 |
| " | 5th coat | " | .0030" | 15,000 | " | .0035" | 20,000 |
| 2550° F., | 1 coat | 5 min. | .0005" | 300,000 | 5 min. | .0005" | 250,000 |
| " | 2nd coat | " | .0015" | 130,000 | " | .0015" | 60,000 |
| " | 3rd coat | " | .0020" | 50,000 | " | .0025" | 20,000 |
| " | 4th coat | " | .0025" | 20,000 | " | .0030" | 15,000 |
| " | 5th coat | " | .0035" | 15,000 | " | .0040" | 10,000 |
| 2500° F., | 1 coat | 5 min. | .0005" | 600,000 | 5 min. | .0005" | 100,000 |
| " | 2nd coat | " | .0005" | 100,000 | " | .0010" | 40,000 |
| " | 3rd coat | " | .0010" | 40,000 | " | .0020" | 20,000 |
| " | 4th coat | " | .0015" | 15,000 | " | .0025" | 15,000 |
| " | 5th coat | " | .0020" | 8,000 | " | .0025" | 12,000 |
| 2450° F., | 1 coat | 5 min. | .0005" | 550,000 | 5 min. | .0005" | 100,000 |
| " | 2nd coat | " | .0010" | 75,000 | " | .0015" | 25,000 |
| " | 3rd coat | " | .0015" | 20,000 | " | .0020" | 10,000 |
| " | 4th coat | " | .0025" | 8,000 | " | .0030" | 9,000 |
| " | 5th coat | 10 " | .0030" | 9,000 | " | .0035" | 6,000 |
| 2400° F., | 1 coat | 5 min. | .0005" | 350,000 | 5 min. | .0005" | 90,000 |
| " | 2nd coat | " | .0010" | 150,000 | " | .0010" | 20,000 |
| " | 3rd coat | " | .0010" | 55,000 | " | .0020" | 15,000 |
| " | 4th coat | " | .0020" | 15,000 | " | .0025" | 5,000 |
| " | 5th coat | " | .0025" | 8,000 | | | |

The good conductivity developed in the short firing time of 5 minutes indicates that the raw oxide forms spinels quickly. The data further indicates that resistance generally decreases as firing temperature decreases. A lower resistance of a layer spaced furthest away from the insulator and the high resistance adjacent the insulator indicate the gradation of the amount of alumina fused into the various layers, after being fired for a prolonged period.

The gradation of the amount of the fusion of alumina into a spinel coating is further shown by the data of Table II. This data was obtained by coating a sintered alumina insulator with the engobe CF-2 above described, then measuring the unit cell size of the spinel. The unit cell size for $CuAl_2O_4$ is listed in Wycoff's "Crystal Structures", Vol. 2 as 8.064 Angstroms. The unit cell size for the spinel formed by the material CF-2 was obtained by firing samples of the spinel in plantinum crucibles at each of two temperatures and measuring its cell size. The closer the unit cell size of the engobe approximates that of $CuAl_2O_4$, means the more alumina has diffused into the spinel. It will be seen that firing the coating at a lower temperature causes less diffusion of the alumina into the spinel coating, and also that the amount of the alumina in the spinel decreases with increasing distance from the alumina body.

TABLE II

| Crystal Phase | | Unit Cell Size |
|---|---|---|
| $CuAl_2O_4$ | Calcined | 8.064 Angstroms |
| CF-2 2650° F., | 1 coat on Alumina | 8.240 Angstroms |
| CF-2 2650° F., | 2 coats on Alumina | 8.308 Angstroms |
| CF-2 2300° F., | 1 coat on Alumina | 8.364 Angstroms |
| $CuFeCrO_4$ 2300° F., and 2650° F. in platinum | | 8.376 Angstroms |

In order to provide adequate service life, the thickness of a semiconductive layer should be at least about 0.010 inch. In order to assure uniformity of individual layers of an engobe coating formed from a slip, the layers should be no more than about 0.001 inch in thickness. It will therefore be seen that forming engobe coatings which are fired after each layer to provide a total thickness of 0.010 inch is quite expensive and impractical. It is also apparent that unless the engobe layer forming a coating at least 0.010 inch in thickness is fired for an appreciable length of time after the last coating is applied, the electrical resistance of the material will not increase with the distance inwardly from the surface of the coating as does the coating of the present invention.

While the data of Tables I and II demonstrate the $Al_2O_3$ diffuses into semiconductive materials, the engobe coatings from which the data of Tables I and II were derived do not represent the advance of the present invention since they do not have the desired thickness nor desired electrical resistance gradient of the preferred embodiment described with reference to FIGS. 1 and 2.

Figure 4:
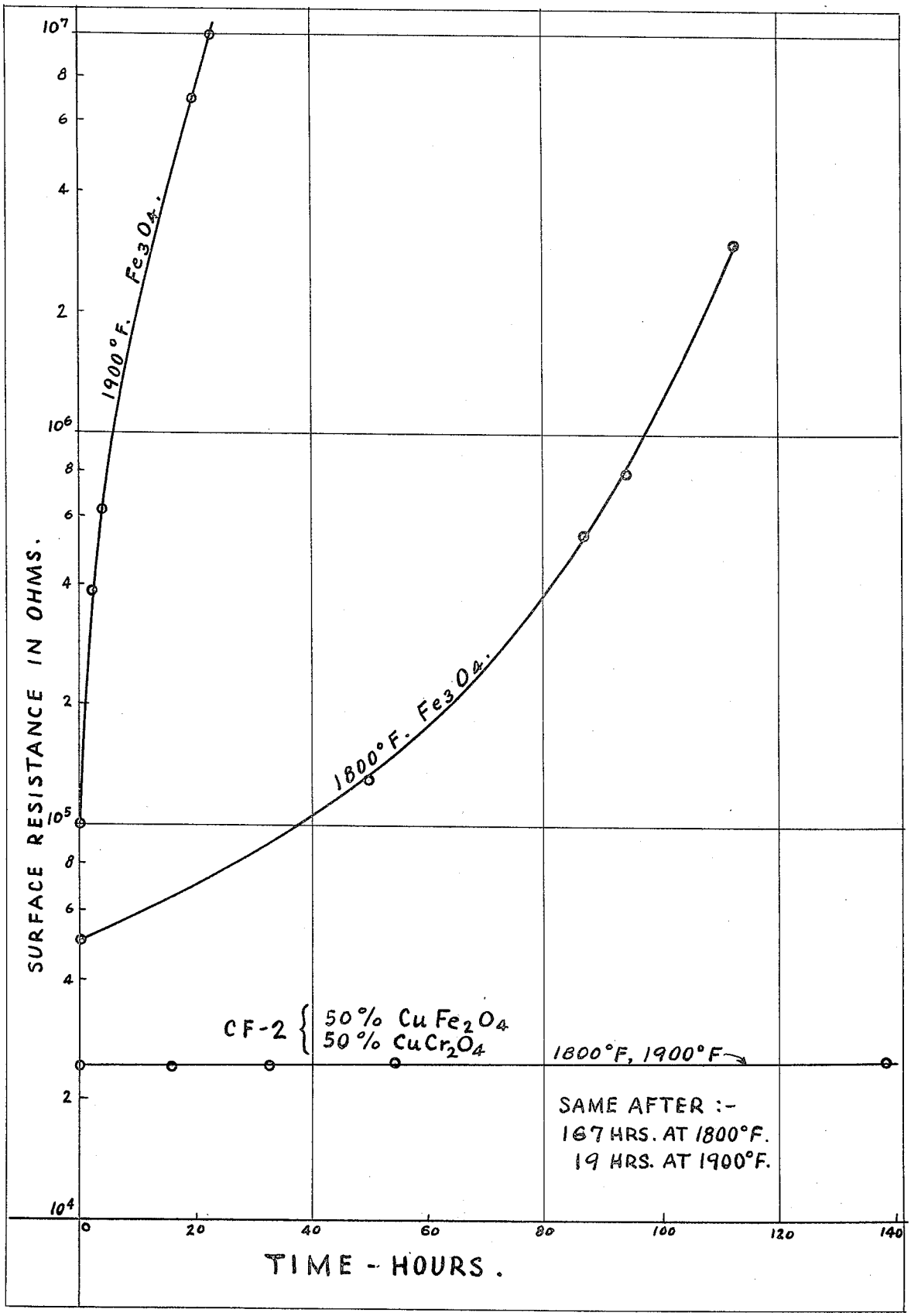

To further demonstrate the thermal stability of spinels, the following tests were performed. A plurality of calcined alumina insulator bodies were dipped into a slip containing, on a dry solids basis, 85 weight percent of $Fe_3O_4$, 10 weight percent of feldspar and 5 weight percent of silica. The coated bodies were fired at 2350° F. for 5 minutes to vitrify the engobe coating. A plurality of the insulator bodies were also coated with a slip of the material CF-2 previously referred to and fired at 2350° F. for 5 minutes. Individual bodies coated with the semiconducting engobes were then heated to temperatures of 1800° and 1900° F. for various times and the resistance of the surface of each coating was measured as above described (500 volts). FIG. 4 is a graph showing the resistance of the various coatings. It will be apparent that coatings of $Fe_3O_4$ are very unstable and that their resistance increases rapidly during exposure to elevated temperatures. This is due to conversion of FeO to $Fe_2O_3$. On the other hand, it will be seen that the CF-2 engobe, which is a spinel having a sesquioxide other than $Fe_2O_3$ present, undergoes substantially no change in electrical resistance at 1800° and 1900° F.

For sufficient stability and adequate service life, the semiconductor must have a thickness of at least 0.010 inch.

In a preferred embodiment it has a thickness of approximately 0.025 inch and its composition is such that it has an electrical resistance approximately twice that at its surface at a point 0.010 inch inwardly from its surface, and it is so constructed that the electrical resistance inwardly at a point 0.010 inch from is exposed surface increases at a progressively increasing rate to that of a non-conductor.

In another preferred embodiment the semiconductive layer formed of a semiconductive oxide is at least 0.015 inch thick, and is fired in contact with an insulator consisting principally of alumina for a sufficient period of time and at a sufficient temperature for the alumina to diffuse into the semiconductive layer and cause the resistance of the semiconductive layer at a point 0.010 inch inwardly of its exposed surface to be approximately twice that at its surface.

While the invention has been described in considerable detail, it is not desired that the invention shall be limited to the particular embodiments shown and described, and it is intended to cover hereby all novel adaptations, modifications, and arrangements thereof which come within the practice of those skilled in the art to which the invention relates.

What I claim is:

1. In a device for producing a spark in a predetermined atmosphere: a pair of spaced apart electrodes end portions of which are exposed to said atmosphere, and a semiconductor having a surface exposed to said atmosphere, disposed between, and in electrical contact with said electrodes, said semiconductor being at least 0.010 inch thick and being constructed and arranged to have its lowest electrical resistance at said surface exposed to said atmosphere and to have electrical resistance which progressively increases at increasing distances inwardly from said surface of said semiconductor exposed to said atmosphere, whereby flow of electricity between said electrodes is concentrated adjacent the exposed surface of said semiconductor.

2. The device of claim 1 wherein said semiconductor has a thickness of approximately 0.025 inch and an electrical resistance approximately twice that at its surface at a point 0.010 inch inwardly from its surface.

3. The device of claim 2 wherein the electrical resistance of said semiconductor inwardly at a point 0.010 inch from its exposed surface increases at a progressively increasing rate to that of a non-conductor.

4. An electrical discharge device comprising: a tubular member having sidewalls which surround a central chamber, said sidewalls having generally inwardly extending surfaces adjacent one end thereof, a center electrode in said chamber, said electrode having generally outwardly extending surfaces opposite said inwardly extending surfaces of said sidewalls, said inwardly and outwardly extending surfaces having a gap therebetween, an insulator positioned between said center electrode and said tubular member, said insulator consisting principally of alumina, and a semiconductive layer at least 0.015 inch thick on said insulator in contact with said inwardly and outwardly extending surfaces, said semiconductive layer comprising at least one oxide which is a semiconductive material and having a gradient of alumina content to cause the resistance of said semiconductive layer at a point 0.010 inch inwardly of its exposed surface to be approximately twice that at its surface, and whereby flow of electricity between said electrodes through said semiconductive layer is generally confined to the surface of said semiconductive layer.

5. An electrical discharge device comprising: a tubular member having sidewalls which surround a central chamber, said sidewalls having generally inwardly extending surfaces adjacent one end thereof, a center electrode in said chamber, said electrode having generally outwardly extending surfaces opposite said inwardly extending surfaces of said sidewalls, said inwardly and outwardly extending surfaces having a gap therebetween, an insulator positioned between said center electrode and said tubular member, said insulator consisting principally of alumina, and a semiconductive layer at least 0.015 inch thick on said insulator in contact with said inwardly and outwardly extending surfaces, said semiconductive layer comprising at least one oxide from the group consisting of FeO, $Cu_2O$, CuO, NiO, CoO, and MnO and at least one oxide from the group consisting of $Fe_2O_3$, $Cr_2O_3$, $Ga_2O_3$, $Ca_2O_3$, $Mn_2O_3$, $Al_2O_3$, and $Ti_2O_3$ and having a gradient of alumina content to cause the resistance of said semiconductive layer at a point 0.010 inch inwardly of its exposed surface to be approximately twice that at its surface, and whereby flow of electricity between said electrodes through said semiconductive layer is generally confined to the surface of said semiconductive layer.

* * * * *